United States Patent [19]

Smith

[11] Patent Number: 4,547,642

[45] Date of Patent: Oct. 15, 1985

[54] COMBINATION MICROWAVE AND THERMAL SELF-CLEANING OVEN WITH AN AUTOMATIC VENTING ARRANGEMENT

[75] Inventor: Peter H. Smith, Anchorage, Ky.

[73] Assignee: General Electric Company, Louisville, Ky.

[21] Appl. No.: 454,972

[22] Filed: Jan. 3, 1983

[51] Int. Cl.[4] ..... H05B 6/64

[52] U.S. Cl. ..... 219/10.55 B; 219/10.55 D; 219/396; 219/10.55 R; 126/21 A

[58] Field of Search ..... 219/10.55 B, 396, 397, 219/398, 10.55 F, 400, 10.55 D, 10.55 R; 126/21 A, 21 R; 236/44 R, 44 A, 44 C, 44 E

[56] References Cited

U.S. PATENT DOCUMENTS

| | | | |
|---|---|---|---|
| Re. 31,094 | 11/1982 | Kobayashi et al. | 219/10.55 B |
| 3,328,560 | 6/1967 | Dills | 219/391 |
| 3,358,674 | 12/1967 | Chisholm | 126/193 |
| 3,387,600 | 6/1968 | Terzian | 126/21 |
| 3,459,921 | 8/1969 | Fussell et al. | 219/396 |
| 3,536,457 | 10/1970 | Henderson | 219/396 X |
| 3,561,421 | 2/1971 | Body et al. | 126/21 |
| 3,659,578 | 5/1972 | Davis et al. | 126/21 R |
| 3,845,270 | 10/1974 | Widugris, Jr. | 219/10.55 |
| 3,859,499 | 1/1975 | Evans et al. | 219/396 |
| 3,882,843 | 5/1975 | Barnett | 126/273 A |
| 4,028,520 | 6/1977 | Torrey | 219/10.55 B |
| 4,039,776 | 8/1977 | Roderick | 219/401 |
| 4,080,564 | 3/1978 | Nitta et al. | 324/65 R |
| 4,096,369 | 6/1978 | Tanaka et al. | 219/10.55 D |
| 4,114,589 | 9/1978 | Berlik et al. | 126/21 R |
| 4,115,678 | 9/1978 | Tachikawa et al. | 219/10.55 B |
| 4,123,643 | 10/1978 | Burke | 219/10.55 R |
| 4,132,878 | 1/1979 | Tachikawa et al. | 219/10.55 B |
| 4,133,995 | 1/1979 | Buck | 219/10.55 B |
| 4,162,381 | 7/1979 | Buck | 219/10.55 B |
| 4,163,894 | 8/1979 | Scherer | 219/391 |
| 4,166,137 | 8/1979 | Buck | 426/423 |
| 4,181,744 | 1/1980 | Buck | 219/10.55 R |
| 4,335,293 | 6/1982 | Kobayashi et al. | 219/10.55 B |
| 4,390,767 | 6/1983 | Bucksbaum et al. | 219/10.55 D |
| 4,392,038 | 7/1983 | Day et al. | 219/10.55 D |

*Primary Examiner*—Roy N. Envall, Jr.
*Assistant Examiner*—M. M. Lateef
*Attorney, Agent, or Firm*—H. Neil Houser; Radford M. Reams

[57] ABSTRACT

A domestic combination microwave and electric self-cleaning oven of the type providing a plurality of operating modes including a microwave mode and a self-cleaning mode is provided with an arrangement for preventing an undesirable buildup of humid air in the cavity when operating in the microwave modes. The venting arrangement includes a restricted air inlet passageway provided to allow outside air to enter the cavity. Air is vented from the cavity through an air exhaust passageway. A catalytic oxidation unit is provided in the air exhaust passageway to decompose gases generated when the oven is operating in the self-cleaning mode. The restricted air inlet passageway is configured to limit unaugmented air flow into the cavity to a level sufficient to facilitate the proper operation of the oxidation unit during operation in the self-cleaning mode. A humidity sensor for sensing the relative humidity of the air exiting the cavity through the exhaust passageway is provided in combination with a blower operative when energized to substantially augment the flow of air into the cavity and blower control circuitry responsive to the sensor and operative to energize the blower when the sensed relative humidity level exceeds a predetermined threshold level. The control circuitry enables energization of the blower only when operating in the microwave modes so that only the unaugmented air flow occurs in other operating modes.

3 Claims, 5 Drawing Figures

COMBINATION MICROWAVE AND THERMAL SELF-CLEANING OVEN WITH AN AUTOMATIC VENTING ARRANGEMENT

BACKGROUND OF THE INVENTION

The present invention relates to domestic cooking ovens and particularly to combination microwave and electric self-cleaning ovens which are selectively operable in a plurality of operating modes including a microwave mode, a combined microwave/bake mode, a bake mode, a broil mode and a self-cleaning mode.

Domestic cooking ovens have been commercially available for a number of years having a cooking cavity which can be used for microwave cooking and combination microwave/bake cooking which uses microwave and thermal energy simultaneously, as well as the conventional baking and broiling. Such ovens also are equipped to provide an automatic self-cleaning cycle which uses the principle of pyrolysis for removing food soil and grease spatter from the inner walls of the cooking cavity. Such cleaning cycles decompose the soils and spatter by degrading them through exposure to high temperatures into gaseous products and carbon residue. The gaseous produces are then passed through an oxidation unit or catalytic smoke eliminator to further degrade the gases before they are returned to the ambient kitchen atmosphere.

For optimum operation of the oxidation unit, it is necessary to supply a small amount of oxygen in the form of room air into the oven cavity. Typically, a gap is provided in the door gasket which provides an otherwise essentially air-tight seal between the door and the cavity when the door is locked in its self-cleaning position. This small gap of predetermined size allows a regulated amount of air sufficient for satisfactory operation in the self-cleaning mode. The amount of air admitted to the cavity during self-cleaning is critical in order to avoid uncontrolled combustion which could occur at the high self-cleaning operating temperature if too much air entered the cavity. Thus, the inlet air passage is configured to admit only a controlled amount of air to the cavity when operating in the self-cleaning mode.

The small air inlet gap admits sufficient air to the cavity for baking, broiling and self-cleaning. However, microwave cooking tends, particularly with some foods such as baked potatoes, and cakes, etc., to generate a great deal of humidity in the cavity, and at a rate which is greater than the rate at which unassisted air enters the cavity through the closely regulated gap and escape from the cavity through the smoke eliminator outlet. As a result, a substantial amount of hot humid air tends to accumulate in the cavity until released by opening the oven door. In addition to the undesirable outrush of hot moist air when the door is opened, the moisture buildup causes condensation to occur on the walls of the cavity which presents potential rust problems.

One approach to solving this problem, as disclosed in U.S. Pat. No. 4,028,520 to S. H. Torrey, is to direct a portion of the magnetron cooling air through the waveguide into the cooking cavity. One drawback of this approach is that the magnetron blower must operate whenever the magnetron is operating. This adversely effects one of the more advantageous operating modes for combination ovens, namely, the microwave/bake mode in which radiant heat is used simultaneously with microwave energy to provide the browning associated with conventional baking and the short cooking time associated with microwave cooking. The continuous circulation of air in the cavity by the magnetron cooling fan when operating in this mode can greatly reduce operating efficiency by removing from the oven air heated by the bake element because magnetron cooling air flow is greater than needed to evacuate the oven. An additional drawback results from the fact that when air flow communication is provided between the waveguide and cavity, the waveguide cannot be tightly sealed from the cavity. Consequently, the air flow path provides a path for moisture condensing inside the oven to enter the waveguide which presents the potential for gradual deterioration of the waveguide due to oxidation over a period of time. Finally, it may also be desirable to blow cooling air over the magnetron during self-cleaning to prevent heat damage due to the extreme temperature in the cavity. To enable cooling air to be blown over the magnetron during the self-cleaning cycle, the portion of air flow directed into the cavity must be limited to the extent that venting the same portion during microwave operation may be less than satisfactory.

It would be desirable therefore to provide a venting arrangement for a combination microwave and electric self-cleaning oven which prevents the buildup of an undesirable amount of hot humid air in the cooking cavity when operating in the microwave and microwave/bake modes, by augmenting air flow through the cavity when needed to remove moist air but which otherwise limits air flow only to that needed for satisfactory operation in the self-cleaning mode and in which the waveguide is tightly sealed off from the cooking cavity so as to prevent moisture condensing in the cavity from entering the waveguide area.

It is therefore an object of the present invention to provide a combination microwave and electric self-cleaning oven with means for satisfactorily removing moist air on demand during operation in the microwave modes.

It is a further object of the present invention to provide a combination microwave and electric self-cleaning oven with means for removing moist air from the cavity when present during operating in the microwave modes, which means provides increased air flow through the cavity when conditions of high humidity exist to rapidly purge such air from the cavity while otherwise limiting air flow to a lesser rate compatible with operation in the bake, broil and self-cleaning modes of operation.

It is a further object of the present invention to provide a combination microwave and electric self-cleaning oven of the aforementioned type in which the waveguide area is tightly sealed to prevent moisture in the cavity from entering the waveguide area.

SUMMARY OF THE INVENTION

The present invention, in accordance with one form thereof, is embodied in a domestic combination microwave and electric self-cleaning oven of the type providing a plurality of operating modes including a microwave mode, a bake mode, a combined microwave/bake mode, a broil mode and a self-cleaning mode. A restricted air inlet passageway is provided to allow outside air to enter the cavity. Air is vented from the cavity through an air exhaust passageway. A catalytic oxidation unit is provided in the air exhaust passageway to decompose gases generated when the oven is operating in the self-cleaning mode. The restricted air inlet passageway is configured to limit unaugmented air flow into the cavity to a level sufficient to facilitate the proper operation of the oxidation unit during operation in the self-cleaning mode. To prevent an undesirable buildup of humid air in the cavity when operating in the microwave modes, a sensor for sensing the relative humidity of the air exiting the cavity through the exhaust passageway, blower means operative when energized to substantially augment the flow of air into the cavity and blower control means responsive to the sensor are provided . The blower control means is operative to energize the blower when the sensed relative humidity level exceeds a predetermined threshold level. Means are also provided to enable energization of the blower only when operating in the microwave modes so that only the unaugmented air flow occurs in the other operating modes.

BRIEF DESCRIPTION OF THE DRAWINGS

While the novel features of the invention are pointed out with particularity in the appended claims, the invention both as to organization and content will be understood and appreciated from the following detailed description taken in conjunction with the drawings in which:

DETAILED DESCRIPTION OF THE INVENTION

Figure 1:
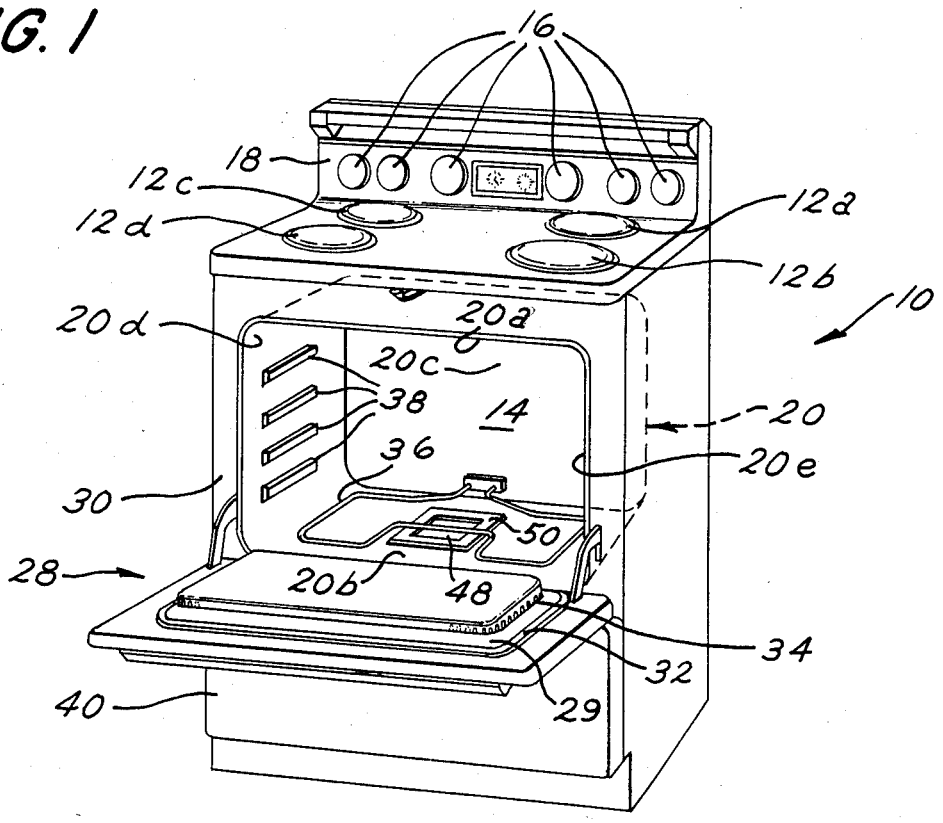
FIG. 1 is a perspective view of a domestic electric range appliance having a combination microwave and electric self-cleaning oven illustratively embodying one form of the present invention.

Referring now to FIG. 1, there is shown a freestanding electric range 10 incorporating a combination microwave and electric self-cleaning oven. Range 10 is, for the most part, conventional in construction, including surface heating units 12*a*–12*d*, an oven cavity 14 and related controls 16 mounted on control panel 18. Oven cavity 14 is formed by an oven liner 20 having horizontal top and bottom walls 20*a* and 20*b* and side walls 20*c*, 20*d* and 20*e*. An oven door 28 is hingedly mounted on the front wall 30 of range 10 and may be provided with a fiberglass gasket 32 to provide a heat seal for oven cavity 14 when door 28 is closed. When a microwave cooking operation is performed, it is necessary also to seal the periphery of the door against microwave leakage. To this end, a slotted choke 34 is provided on the inner panel 29 of oven door 28. Other alternative means of sealing against microwave energy usage may be employed in accordance with principles well known in the art, such as providing a conductive wire mesh in gasket 32 in contact with the front periphery of oven cavity 14. The oven includes a conventional lower bake heater unit 36 and an upper broiler heater unit (not shown). A series of parallel rack supporting ridges 38 are formed on side walls 20*d* and 20*e* such that conventional wire racks (not shown) may be slidably supported in the usual manner. Thermal insulation 39 (FIG. 2), such as fiberglass or the like, is assembled around the outside of oven liner 20 to retain the oven heat within the oven cavity. The area beneath oven cavity bottom wall 20*b* housing the microwave excitation system is closed from the front by lower front panel 40.

Door locking and electrical interlocking means designated generally 42 (FIG. 2) and including handle 44 are provided in the heating circuit (not shown) in conventional fashion to insure that the self-cleaning cycle cannot raise the temperature in cavity 14 above the normal cooking temperature range (150°–550° F.) unless the oven door 28 is both closed and locked. Moreover, oven door 28 may not be unlocked while the oven temperature is above about 600° F.

Figure 2:
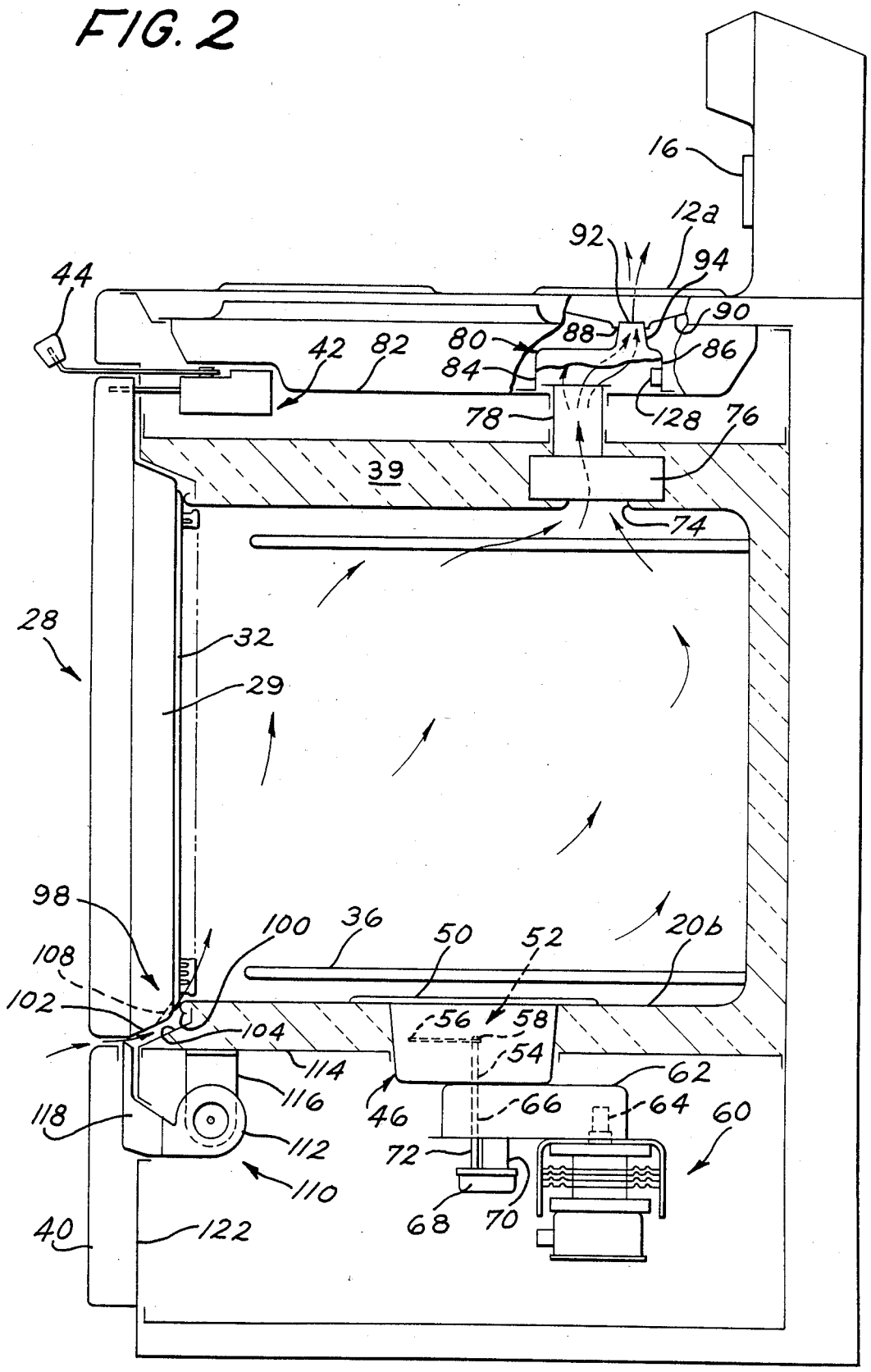
FIG. 2 is a highly schematic side elevational view of the range appliance of FIG. 1.

Referring now to FIG. 2, the microwave excitation system for range 10, includes a circular waveguide section 46 adapted to be in microwave communication with oven cavity 14 through bottom wall 20*b*, with the upper open end thereof aligned with a feed aperture formed in bottom wall 20*b*, positioned generally centrally thereof. The upper end of waveguide 46 is closed by a layer or plate 48 of low dielectric material, such as for example glass ceramic, the basic function of which is to prevent food soil and other matter from entering waveguide 46. Plate 48 is held in place by a metal trim frame 50 attached to waveguide 40 and bottom wall 22 by means of screws (not shown). A gasket (not shown) is interposed between trim frame 50 and bottom wall 20*b* and waveguide 46 to electrically insulate trim frame 50 from wall 20*b* and waveguide 46 except at the contact points provided by the attaching screws. Screw contact points are spaced apart by a distance $3\lambda/4$ to assure that circulating currents are not established in trim frame 50. A movable antenna 52 is mounted within waveguide 46 with a vertical segment 54 coaxial with waveguide 46 and laterally extending arm 56 with the arm 56 joined to segment 54 at the right angle by bolt 58.

Microwave energy is provided by conventional magnetron 60 operating at a standard frequency of 2450 MHz. Microwave energy from magnetron 60 is coupled into rectangular waveguide 62 in a conventional manner by magnetron probe 64. The energy is then propagated along the length of waveguide 62 and is coupled to antenna 52 by antenna probe comprising portion 66 of vertical segment 54 which extends into waveguide 62. A motor 68 is mounted to the underside of rectangular waveguide 62, such as by mounting bracket 70. Drive rod 72 of electrically non-conductive material drivingly links motor shaft 68 to segment 54 of antenna 52 to rotate antenna 52 when power is applied to the motor. The microwave excitation system is described in detail in commonly-assigned U.S. Pat. No. 4,316,064 to Fitzmayer, the disclosure of which is hereby incorporated by reference.

To facilitate operation in the self-cleaning mode, oven cavity 14 is provided with an exhaust vent 74 located in the top wall 20*a* of liner 20 for exhausting the hot oven gases from the oven cavity. Interposed in the oven vent passageway is a catalytic oxidation unit 76, or smoke eliminator, which is a small, separately heated chamber that includes a catalytic surface (not shown) to further decompose the smoke and gases passing therethrough generated during operation in self-cleaning mode, before they are returned to the kitchen atmosphere. Oxidation unit 76 may be of the general type described in commonly-assigned U.S. Pat. No. 2,900,483 to Stanley B. Welch, the disclosure of which is hereby incorporated by reference. Vent tube 78 defines an outlet air passageway from oxidation unit to vent housing 80. Vent housing 80 is a generally rectangular box-like housing supported from support pan 82 with one end 84 covering vent tube 78. The other end 86 of housing 80 extends beneath the bottom opening 88 in reflector 90 of heating element 12*a*. An exhaust outlet port 92 is formed in housing 80 directly beneath and aligned with opening 88 in reflector 90. Outlet port 92 of housing 80 comprises an upwardly extending cylindrical sleeve 94 of diameter slightly less than the diameter of the reflector opening 88 to enable sleeve 94 to extend upwardly through opening 88 in reflector 90. This arrangement provides an exhaust air flow path from vent 74 through oxidation unit 76 to the outside atmosphere through drip pan 90. The lateral offset between vent tube 78 and outlet port 92 of housing 80 prevents food soils in the reflector from entering the vent tube.

Figure 3:
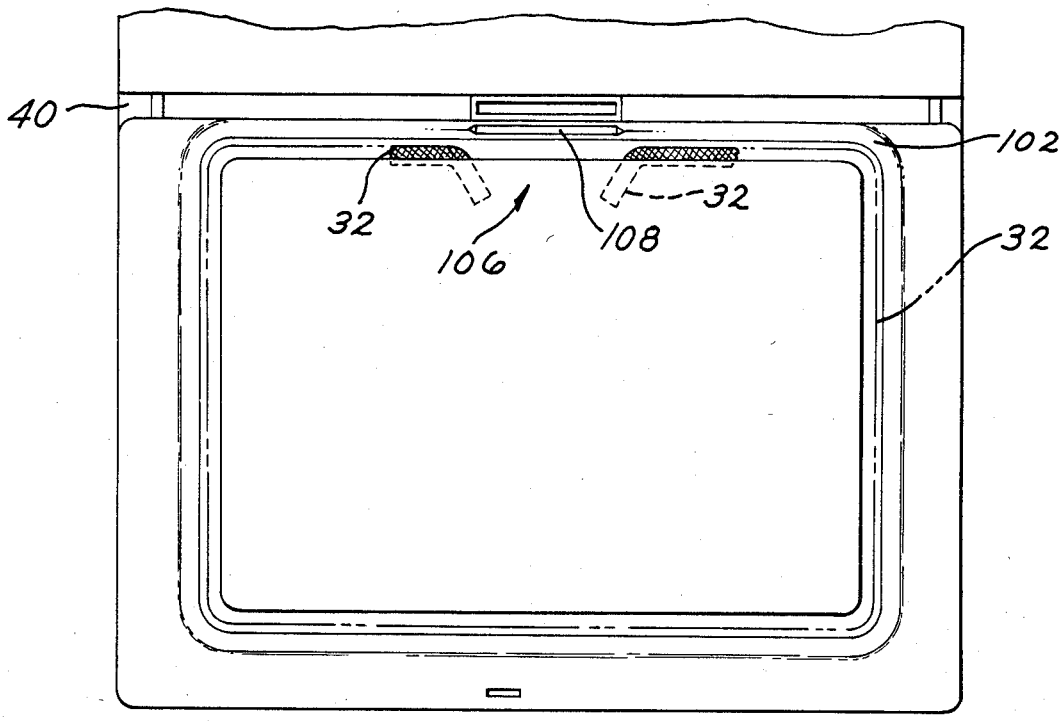
FIG. 3 is a fragmentary plan view of the inner surface of the door and the lower lip area of the oven opening of the range appliance of FIG. 1 with the door in the open position, illustrating details of portions of the air inlet passageway.
Figure 4:
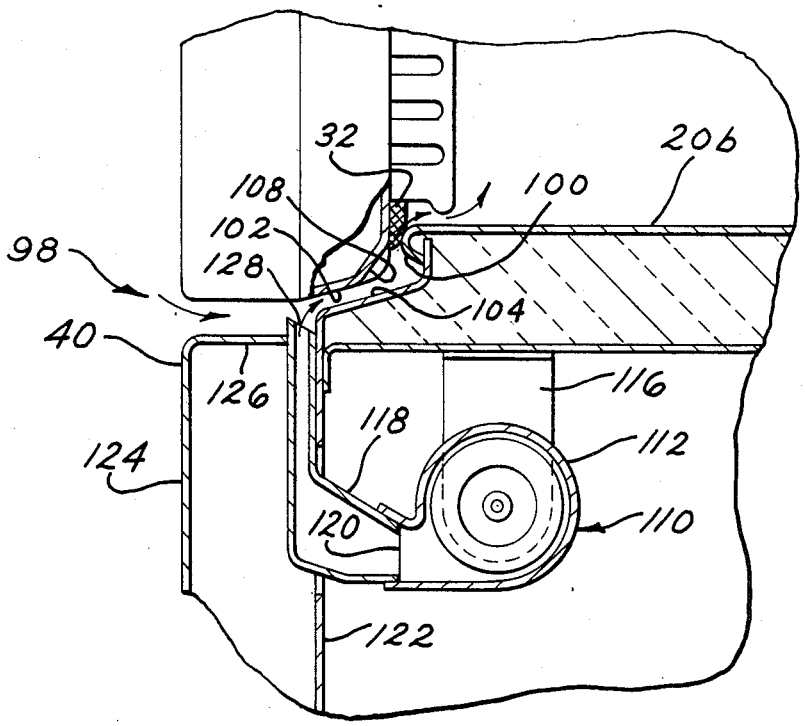
FIG. 4 is an enlarged fragmentary cross-sectional side elevational view showing the interrelationship of the lower portion of the oven door with the lower lip area of the oven door opening and the air blower.

Oxidation unit 76 requires a supply of oxygen for proper controlled combustion of the exhaust gases within the unit. This ovygen is supplied by creating a gentle sweep of room air through oven cavity 14. Air is admitted to oven cavity 14 for this purpose via an air inlet means or passageway, designated generally 98, provided in conventional fashion at the interface between the lower portion of the inner panel 29 of door 28 and the peripheral lip 100 of the front opening of oven liner wall 20*b*. As best illustrated in FIGS. 2–4, inner door panel 29 has an inwardly extending flange 102 substantially conforming to the tapered shoulder 104 formed about the periphery of the front facing opening of oven 14. A slight clearance is provided between flange 102 and shoulder 104 to permit air passage therebetween. Shoulder 104 which extends about the front periphery of oven liner 20 engages gasket 32 to close off this space between the oven liner except in the lower central portion of the front periphery, where a gap designated generally 106 is defined by gasket 32 to partially define a regulated air inlet passageway permitting outside air to enter cavity 14. A complementary depression 108 is formed in flange 102 of inner door panel 29 to complete the opening for air inlet passageway 98. The resultant air flow path is illustrated by appropriate arrows in FIGS. 2 and 4. The length and shape of the path for the air entering the cavity as well as the size of the opening for passageway 98 serves to regulate the amount of air which enters the cavity and also serves to prevent any flame which might result from excessive grease on the oven during a self-cleaning cycle from flashing back through the passage to the outside of the oven.

During operation in the self-cleaning mode, the high heat generated in oxidation unit 76 creates enough of a draft to draw air through this inlet passage into the oven at a rate on the order of 2–3 cubic feet per minute. This rate provides sufficient air flow for satisfactory operation of the oxidation unit, while limiting the air flow to a rate which does not permit uncontrolled combustion to occur in the oven cavity.

Figure 5:
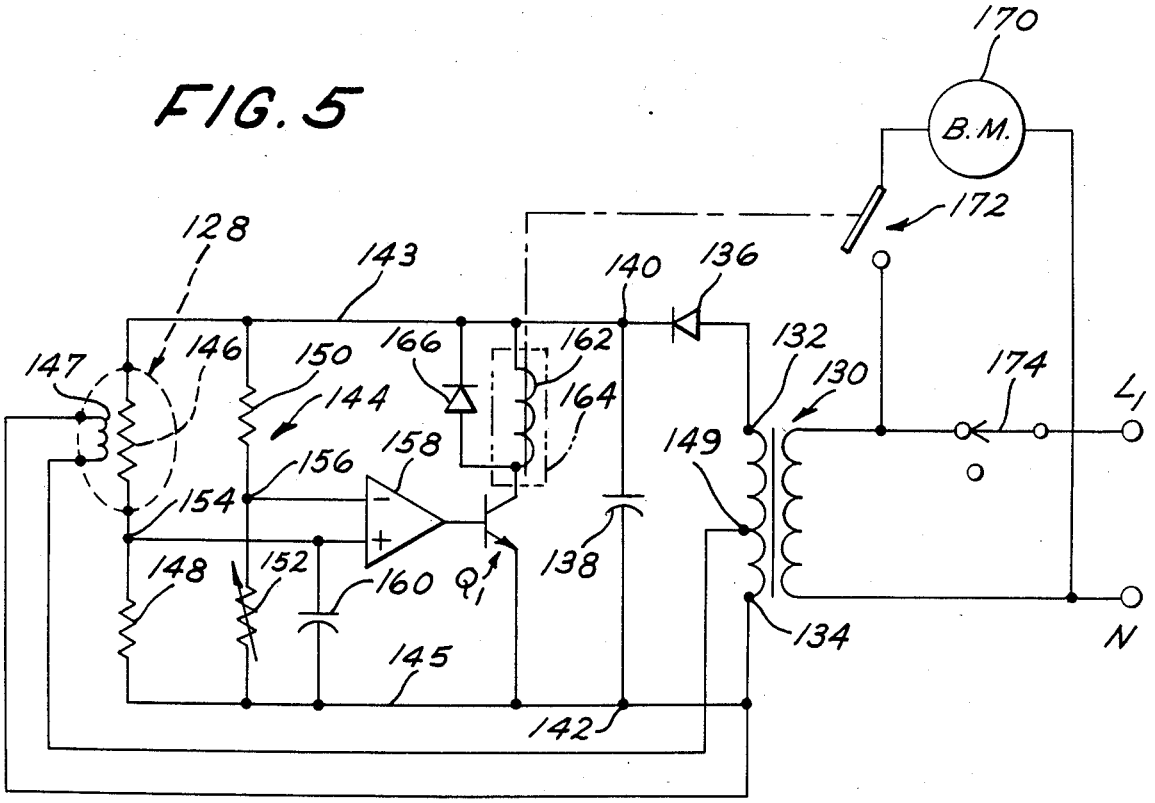
FIG. 5 is a schematic diagram of the circuit for controlling blower operation in the range appliance of FIG. 1.

The oven cavity structure described thus far is essentially conventional and has been shown to provide satisfactory oven ventilation when operating in the bake, broil and self-cleaning modes. However, as briefly mentioned hereinbefore in the background discussion, microwave cooking, particulary with certain foods such as baked potatoes tends to generate a considerable amount of humidity in the oven cavity which presents two undesirable side effects. First, there is the potential for an undesirable rush of humid air from the oven when the oven door is opened, and, second, there is the tendency for condensation to form in the cavity which could lead to gradual deterioration by rusting. The unaugmented air flow of outside air through cavity 14 via air inlet 106 is not sufficient for totally satisfactory venting of the humid air from the oven cavity. in accordance with the present invention, means are provided to augment the rate of flow of outside air through oven cavity 14 when humid air is detected in the cavity. In the embodiment of FIGS. 2–4, this means includes blower means designated generally 110 comprising a motor driven fan (not shown) enclosed in housing 112 secured to insulation retaining wall 114 near air inlet opening 98 by mounting bracket 116. The fan and motor comprising blower means 110 may be of conventional design and construction. A blower outlet duct 118 extends from fan housing outlet 120 through an opening in inner face 122 of lower panel 124 and upwardly along the inner face 122 through an opening in the inwardly extending flange 126 of lower panel 124 with the exit port 128 of duct 118 directly adjacent the air inlet gap 98. Outlet duct 118 channels forced air from blower means 110 through air inlet gap at 98 when the blower means is energized by applying power to the fan blower motor 170 (FIG. 5). Thus, when the blower means is energized, the rate of flow of outside air into the cavity through inlet passageway 106 is substantially increased. Specifically, in the illustrative embodiment the blower means 110 moves air at a rate on the order of 50 $ft.^3$/minute, so as to rapidly purge the humid air from the cavity. Blower means 110 draws air from the area between the bottom of oven liner 20 and the floor supporting the appliance.

Since not all foods, when cooked by microwave, generate significant amount of humidity and because a constant substantial air flow during operation in the microwave/bake mode is undesirable from an energy efficiency and cooking performance standpoint, the blower means, in accordance with the present invention, is only energized when relative humidity level of the exhaust air exiting fom vent tube 78 exceeds a predetermined threshold level. In the illustrative embodiment, this level is set at 90 percent relative humidity. It has been empirically determined that, in the illustrative oven, this level satisfactorily limits condensation and avoids the undesirable sudden release of hot humid air from the cavity upon opening the oven door, while at the same time not requiring excessive energization of the blower means. It is understood that the threshold level described is for illustrative purposes and is not intended to limit the scope of the present invention.

In accordance with the present invention, means for sensing the relative humidity level of the air exiting to the oven cavity is provided by a humidity sensor 128 positioned to sense the relative humidity of the air passing from cavity 14 to the kitchen atmosphere. In the illustrative embodiment, sensor 128 is suitably secured to the inner wall of vent housing 88, preferably on the end wall adjacent opening 92, to sense the relative humidity level of the exhaust air as it passes from oxidation unit 76 through vent housing 80 to the outside.

An embodiment of control means for controlling the blower means in accordance with the present invention is illustrated schematically in the circuit diagram of FIG. 5.

Power for energizing the circuitry of FIG. 5 is provided by a standard 120 volt 60 Hz power signal such as is commonly available at domestic power receptacles which is applied across lines L1 and N. A 10:1 stepdown transformer designated generally 130 steps the 120 volt signal down to provide a 12 volt ac signal across secondary terminals 132 and 134. Diode 36 and capacitor 138 form a half-wave rectification and smoothing network which provies a 15 volt dc signal across terminals 140 and 142. This dc signal is applied via conductors 143 and 145 to a four-leg impedance bridge network 144, which incorporates humidity sensor 128.

Humidity sensor 128 of the illustrative embodiment is a tin oxide humidity sensor of the type manufactured by and readily commercially available from Figaro Engineering Incorporated of Minoo City, Osaka, Japan, identified by the model designation TGS No. 816, for use in microwave oven applications. Sensor 128 comprises a resistive sensing element 146 and a heater coil 147. Heater coil 147 is energized by a 5 volt ac 60 Hz signal derived across tap 149 and terminal 134 of the secondary of stepdown transformer 130. The resistance of sensing element 146 varies inversely with humidity from a value of roughly 60K ohms at 10 percent relative humidity to roughly 40K ohms at 90 percent relative humidity. Sensing element 146 is connected as the first leg of impedance bridge network 144 which comprises in the second leg resistor 148, in the third leg resistor 150 and in the fourth leg adjustable trimming resistor 152. The bridge network includes comparison terminals 154 and 156 at the junction of the first and second legs and at the junction of the third and fourth legs, respectively. Comparison terminals 154 and 156 are connected to the non-inverting and inverting inputs, respectively, of a comparator 158 which responds to the voltage unbalance of the bridge network. Smoothing capacitor 160 is connected between the non-inverting input and conductor 145 to smooth any ripples induced by the alternating current flowing in heating circuit for sensor 128. The output of comparator 158 is applied to the base of switching transistor $Q_1$ which controls energization of relay coil 162 of relay 164 which control energization of the blower motor. Relay coil 162 is serially connected between the collector of transistor $Q_1$ and conductor 143. Voltage catching diode 166 is connected in parallel with relay coil 162 to provide a transient current path when transistor $Q_1$ switches off. Blower motor 170 is connected across Lines L1 and N in series with the normally open contacts 172 of relay 164. Also in series with blower motor 170 is an enabling switch 174 which responds to user selection of oven operating mode. Switch 162 is closed when the user selects the microwave only or combination microwave/bake mode and open otherwise. When switch 174 is closed, blower motor energization is controlled by relay 164, in response to the humidity sensor 128; when switch 162 is open, fan motor 170 is disabled regardless of the state of the relay switch.

In operation, when the relative humidity of the air in vent housing 80 is less than the 90 percent threshold level, the resistance of sensing element 146 is greater than 40K ohms, the value associated with the 90 percent relative humidity level. The resultant voltage at terminal 154 and applied to the non-inverting input of comparator 158 is less than the voltage at terminal 156 applied to the inverting input. Consequently, the output of comparator 158 is low, causing switching transistor $Q_1$ to be non-conductive and relay 164 to be in its normally open state. When the relative humidity level sensed by sensor 128 reaches or exceeds 90 percent, the resistance of the sensor element 146 drops to or below 40K ohms, causing the voltage at the non-inverting input of comparator 158 to exceed that at its inverting input. The output of comparator 158 switches high, switching transistor $Q_1$ into conduction. Normally open contacts 172 close, thereby energizing blower motor 170. The circuit remains in this operating condition until the sensed relative humidity level drops below the 90 percent level, at which time the comparator output switches once again to its low state, switching transistor $Q_1$ into is non-conductive state, thereby deenergizing relay coil 162 and switching relay 164 to its normally open state deenergizing the blower motor 170.

The following components and component values have been found suitable for use in the circuit shown in FIG. 4. These values are exemplary only and are not intended to limit the scope of the claimed invention.

| | |
|---|---|
| | Humidity Sensor |
| | FIGARO TGS No. 816 |
| | Fixed Resistors |
| 148 | 12 K ohms |
| 150 | 5.1 K ohms |
| | Variable Resistor |
| 152 | 1.2 K ohms |
| | Capacitors |
| 138 | 200 uf |
| 160 | 200 uf |
| | Diodes |
| 136 | IN 914 |
| 166 | IN 914 |
| | Transistor |
| $Q_1$ | 2N 2222 |
| | Relay |
| 164 | 15 volt DC Coil |
| | Transformer |
| 130 | 12 volt AC Secondary |
| | Comparator |
| 158 | LM 2901 |
| | Blower Motor |
| 170 | 3400 RPM, 0.5 amp Motor |

It will be apparent from the foregoing that the present invention provides a relatively simple and effective means for rapidly venting humid air from the cooking cavity of a combination microwave and electric self-cleaning oven which can be incorporated into such ovens with a minimum of change to the basic oven structure.

While specific embodiments of the invention have been illustrated and described herein, it is realized that modifications and changes will occur to those skilled in the art to which the invention pertains. It is therefore intended to cover all such modifications and changes as fall within the true spirit and scope of the invention.

What is claimed is:

1. In a combined microwave and thermal self-cleaning oven of the type having a plurality of operating modes including a microwave mode and a self-cleaning mode, and comprising an oven cavity formed by a box-like oven liner having an access opening formed in one wall thereof, a door for closing said opening, a sealing gasket to seal the space between said liner and door when said door is closed, an exhaust passageway for venting air from said cavity, a catalytic oxidation unit interposed in said exhaust passageway for decomposing gases generated in the self-cleaning mode, and a restricted air inlet passageway defined by a gap through said sealing gasket and configured to meter only a regulated amount of outside air into said cavity to facilitate the controlled combustion of exhaust gases in the oxidation unit when the oven is operating in the self-cleaning mode, the improvement comprising:

sensing means for sensing the relative humidity of air exiting the cavity through the exhaust passageway;

blower means including a blower outlet positioned adjacent said gap operative when energized to increase the flow rate of outside air into the cavity through said gap;

blower control means responsive to said sensing means and operative to energize said blower means only when the sensed relative humidity level exceeds a predetermined threshold level indicative of excessive humidity in the cavity; and means for enabling energization of said blower means only when operating in the microwave mode or the microwave/bake mode;

whereby when operating in the microwave mode or microwave/bake mode, humid air is purged from the cavity thereby preventing a steam buildup in the cavity.

2. The improvement of claim 1 wherein said sensing means comprises a humidity sensor mounted in said exhaust passageway to sense the relative humidity of the air exiting from the oxidation unit.

3. The improvement of claim 1 wherein said sensing means comprises a sensor characterized by a resistance which varies inversely with sensed relative humidity, and wherein said blower control means comprises: a multi-leg bridge network incorporating said sensor in one leg thereof, said network generating an output voltage signal representative of said sensed humidity; comparator means operative to compare said network output signal with a predetermined reference voltage representing said threshold relative humidity; and relay means responsive to said comparing means and operative to enable the energization of said blower means when said network output signal exceeds said reference voltage.

* * * * *